United States Patent [19]

Schrecongost

[11] 4,297,935

[45] Nov. 3, 1981

[54] DIVIDER KEYER CIRCUIT FOR SYNTHESIS ORGAN

[75] Inventor: Ray B. Schrecongost, Park Ridge, Ill.

[73] Assignee: Marmon Company, Chicago, Ill.

[21] Appl. No.: 880,829

[22] Filed: Feb. 24, 1978

[51] Int. Cl.[2] ..... G10H 5/02

[52] U.S. Cl. ..... 84/1.01; 84/1.19; 84/DIG. 11; 84/DIG. 23

[58] Field of Search ..... 84/1.01, 1.03, 1.11, 84/1.12, 1.13, 1.19, 1:2, 1.21, 1.22, 1.23, 1.26, DIG. 7, DIG. 8, DIG. 11, DIG. 23

[56] References Cited

U.S. PATENT DOCUMENTS

| | | | |
|---|---|---|---|
| 3,636,231 | 1/1972 | Schrecongost | 84/DIG. 8 |
| 3,743,756 | 7/1973 | Fransson | 84/DIG. 11 |
| 3,748,944 | 7/1973 | Schrecongost | 84/1.22 |
| 3,755,609 | 8/1973 | Millet | 84/1.23 |
| 3,972,259 | 8/1976 | Deutsch | 84/1.24 |
| 4,055,103 | 10/1977 | Machanian | 84/DIG. 23 |
| 4,083,286 | 4/1978 | Faulkner | 84/1.13 |

*Primary Examiner*—J. V. Truhe
*Assistant Examiner*—William L. Feeney
*Attorney, Agent, or Firm*—Neuman, Williams, Anderson & Olson

[57] ABSTRACT

A divider keyer circuit arrangement for a synthesis organ utilizing four integrated circuit chips to generate the notes for a 61 key manual with 9 harmonic drawbacks or tabs. On-chip cross wiring and the use of clock lines for synchronization pulses and other design techniques enable the use of four identical integrated circuit chips in standard 40 pin packages to be used to generate the full complement of notes for a 61 note keyboard.

7 Claims, 5 Drawing Figures

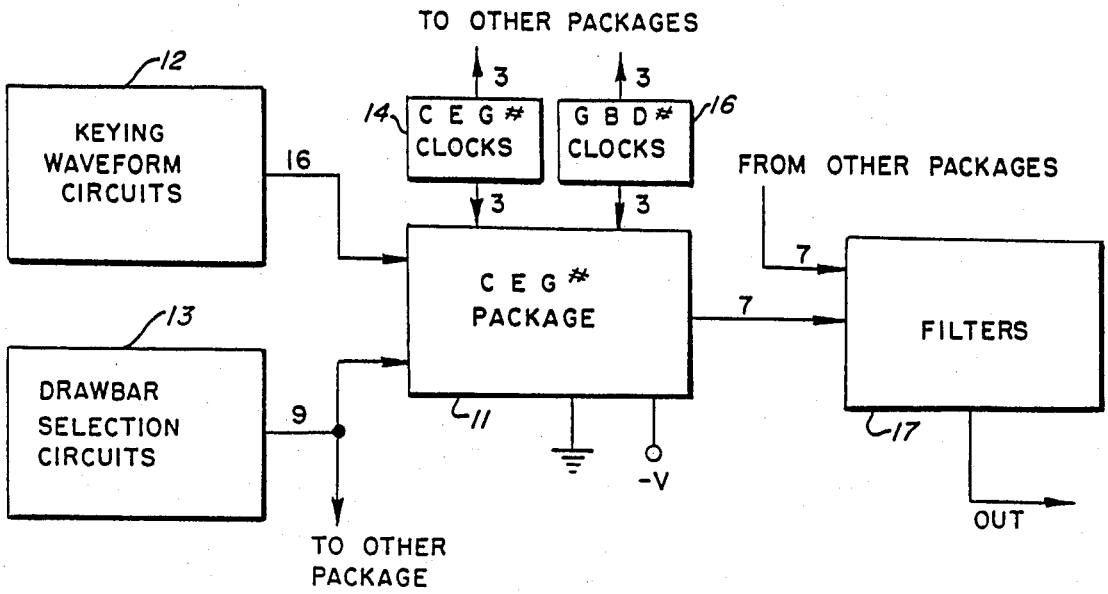
FIG. 1
FIG. 2
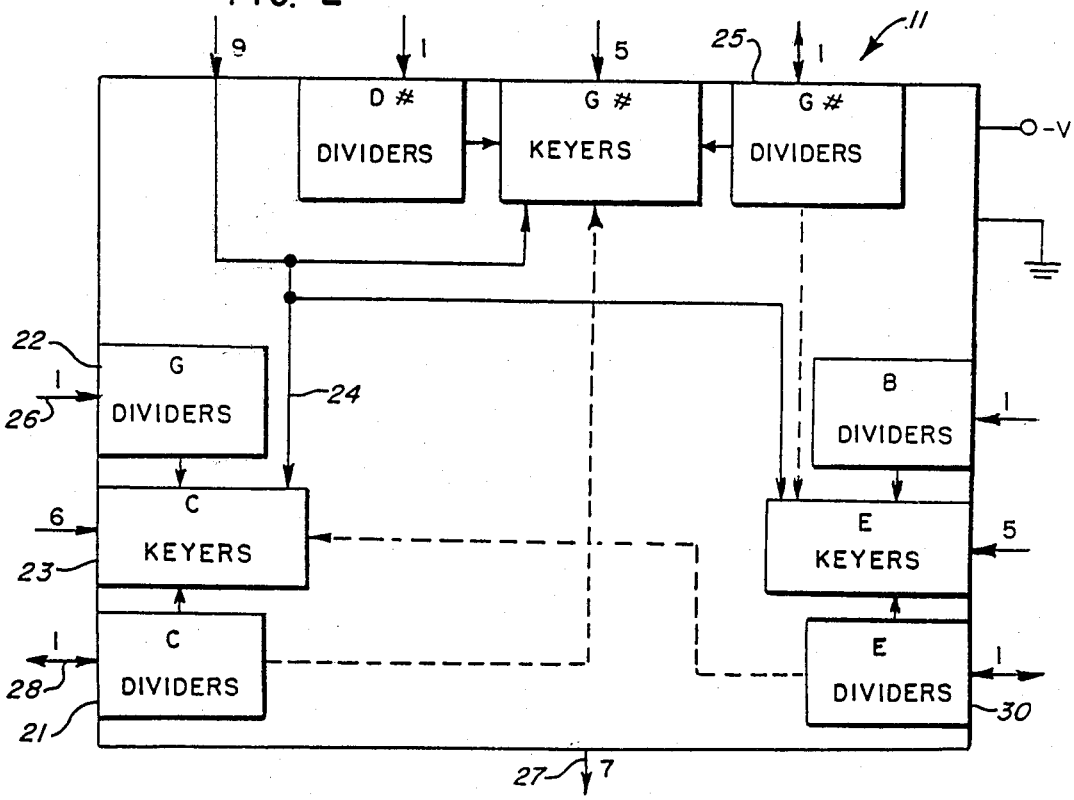

DIVIDER KEYER CIRCUIT FOR SYNTHESIS ORGAN

BACKGROUND OF THE INVENTION

1. Field of the Invention

The invention is in the field of electronic organs.

2. Description of the Prior Art

A DC keyed synthesis organ employing an integrated circuit is shown in U.S. Pat. No. 3,636,231 to Schrecongost, et al, and assigned to the assignee of the present application. This patent shows a synthesis-type organ with direct current keying and individual harmonic scaling utilizing integrated circuit techniques. Subsequently, there is shown in U.S. Pat. No. 3,748,944 to Schrecongost, and also assigned to the assignee of the present application, an integrated circuit organ system wherein the principal embodiment shows the utilization of thirteen integrated circuit packages as divider keyers for each keyboard of the organ. This patent does show various numbers of integrated circuit chips which might be used to produce the 61 notes for an organ manual, but there is no showing of a circuitry approach for utilizing four integrated circuit chips having a standard forty pin configuration, and in fact the '944 patent indicates a preference for a thirteen package approach.

SUMMARY OF THE INVENTION

One embodiment of the present invention is a divider keyer circuit arrangement for a 61 note electronic synthesis organ keyboard having a plurality of harmonic controls which includes four identical forty pin integrated circuit packages, each of which comprises, a first note-related keyer section having six keyer groups each of which is couplable to a different keying wave form input line and each of which has a plurality of keyers couplable to a different harmonic control line, a first primary divider section couplable on a first clock line to a top octave clock generator output for said first note and including a series of dividers operable to divide said generator output successively by two to produce a series of tone signal divider outputs and further including means for generating a synchronization signal on said first clock line and further including a synchronization signal detection means coupled to said first clock line for detecting said synchronization signal and resetting said dividers in response thereto, a first third-harmonic divider section couplable on a first third-harmonic clock line to a top octave clock generator output for a note third harmonically related to said first note, said third-harmonic top octave clock generator output being utilized as a primary divider section top octave source for a note on a different one of said four identical integrated circuit packages, and including a series of dividers operable to divide said output successively to two to produce a series of tone signal divider outputs and further including a synchronization signal detection means coupled to said first third-harmonic clock line for detecting a synchronization signal placed on said clock line by a synchronization signal generating means on another one of said four identical integrated circuit packages and for resetting said third-harmonic dividers in response thereto, and a second note-related keyer section having five keyer groups, a third note-related keyer section having five keyer groups, a second primary divider section, a third primary divider section, a second third-harmonic divider section, and a third third-harmonic divider section, said keyers in the first note-related keyer section each being coupled to a tone signal output from one of the following divider sections: the first primary divider section, the first third-harmonic divider section, and the second primary divider section.

BRIEF DESCRIPTION OF THE DRAWINGS

FIG. 1 is a block diagram showing of an electronic organ including a divider keyer integrated circuit package according to an embodiment of the present invention.

FIG. 2 is a more detailed block diagram of the integrated circuit package of FIG. 1.

DESCRIPTION OF THE PREFERRED EMBODIMENT

Figure 3:
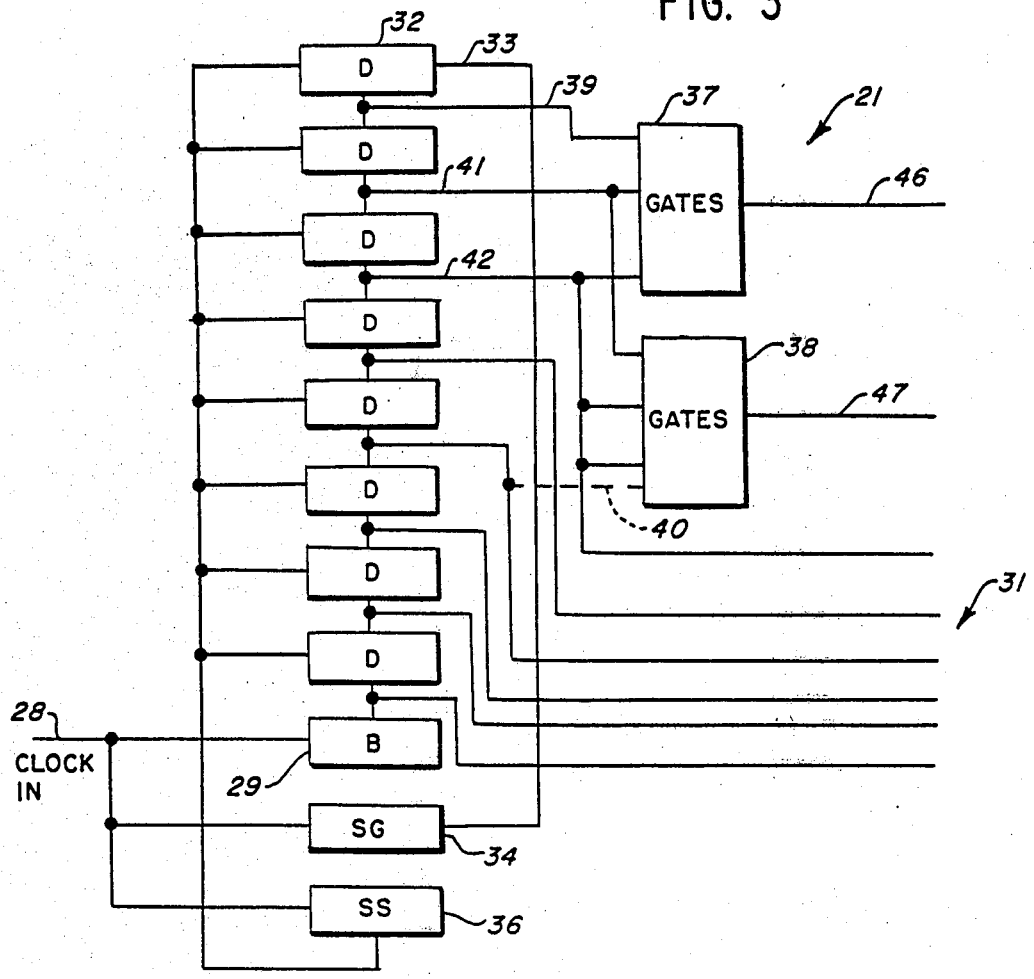
FIG. 3 is a more detailed showing of a divider section as shown in FIG. 2.

Referring in particular to FIG. 1, there is shown a block diagram of the note generation circuitry for one keyboard of an electronic organ. One of four identical divider keyer packages is illustrated, that being the CEG# package 11.

The 16 keying lines from the keying and envelope generation circuits for the 6 C keys, 5 E keys and 5 G# keys are coupled from keying envelope waveform generator circuit section 12 to the divider keyer package 11. There are 15 similar keying lines running to each of the other three divider keyer packages, for a total of 61 keys, with the 16th input line only being used in the CEG# package to generate the extra C for a 61 note manual.

The 9 drawbar lines from drawbar selection circuits 13 are coupled to package 11 and also to the other three packages making up the divider keyer system. The C, E and G# clock pulses which are divided down within package 11 to make the various note frequencies for the keyers are obtained from clock circuit 14. The third harmonic clock pulses for generating the third harmonic, sub third and sixth harmonic signals for the C, E and G# notes in package 11 are coupled from clock circuit 16. Similarly, the C#, F and A divider keyer package (not shown) has inputs from other clocks signified by those note letters as well as the C, E and G# clocks to generate the third harmonic signals. The D, F# and A# divider keyer package (not shown) receives clock signals from other clocks signified by their note letters and also the A, C# and F clocks for generating thirds; and the D#, G and B package (not shown) receives clock signals from other clocks signified by those note letters as well as the D, F# and A# clocks for generating thirds. All of the 12 top octave frequencies may be derived from a master oscillator or multiple derivative divider (MDD) circuit as set forth in the above-mentioned U.S. Pat. No. 3,748,944.

The divider keyer package outputs are assembled into 7 frequency related groups and coupled to appropriate sine filter circuits 17 which also receive similar frequency group outputs from the other divider keyer packages. The final two connections to divider keyer package 11 are ground and a negative supply voltage, making a total of 40 pin connections necessary for the package.

Figure 5:
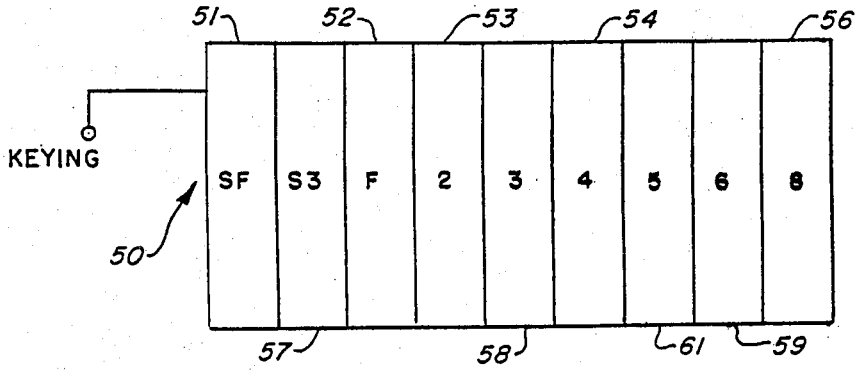
FIG. 5 is a more detailed diagramatic showing of a keyer circuit of FIG. 2.

Referring now to FIG. 2, further detail of the interior of integrated circuit package 11 is shown in block diagram form. Since each of the divider keyer sections of the chip are essentially the same, the dividers and keyers 21, 22 and 23 associated with the generation of the C notes shall be discussed in detail. Each of the three note letter groups to be generated in integrated circuit package 11 require a different set of 7 or 8 external connections for the dividers and keyers. The extra keyer connection for the C note group is required due to the generation of a sixth C while all of the other 11 notes in a standard organ manual have five keys associated therewith. When a divider keyer package such as 11 is used for one of the other note trios where C#, D or D# is the low note in the package, only 5 keying circuit connections are utilized There are six keyer groups in C keyer section 23. Each keyer group is connected to a different keying waveform input line. There are nine keyers in each keyer group, and the first keyer in each group is connected to the same drawbar line, etc. The nine drawbar lines are indicated generally at 24. This makes a total of 54 keyers. The appropriate tone frequencies must be provided for each keyer by dividers 21 and 22. Referring for a moment to FIG. 5, there is shown diagramatically one of the sets 50 of keyers associated with one keying line such as a C line from keying and envelope generation circuit 12. The C keyers each receive a drawbar voltage and a tone signal input from the appropriate C divider to provide the subfundamental 51, fundamental 52, second harmonic 53, fourth harmonic 54 and eighth harmonic 56 from the C dividers. The sub third 57, third harmonic 58 and sixth harmonic 59 are obtained from the G dividers, which requires a separate top octave G clock input on line 26 (FIG. 2). The fifth harmonic keyer portion 61 for each C keyer section 50 receives its tone signal input from the E dividers which are already located on package 11. Similarly, the fifth harmonic tone signals may be borrowed from dividers already on the divider keyer package as shown by the dashed lines in FIG. 2. The same borrowing connections are appropriate whether (reading counterclockwise) the keyers on a package are CEG#, C#FA, DF#A#, or D#GB.

The seven frequency group outputs shown at 27 are coupled from all three of the keyer sections on the divider keyer package, but the connections are not shown in FIG. 2 to simplify the drawing. In order to insure that all of the C notes, and all other note letter related tones, should be in phase or synchronized with themselves in the four package note generation circuitry, synchronization and resetting of all like dividers is necessary. The above-mentioned U.S. Pat. No. 3,748,944 illustrates a system of synchronization and clear lines running into each of the divider keyer chips shown in that patent. In the present scheme, the clock lines such as 26 and 28, for the G dividers and C dividers respectively, are used not only to provide clock pulses to the dividers but also to carry synchronization pulses.

Referring now to FIG. 3, there is shown a divider section such as the C divider section 21 in more detail. The clock input 28 is of the highest C to be used in the keyers and after being coupled through buffer 29 is the highest of the square wave outputs 31 coupled to the keyers for the various harmonics of the various C tones. Higher harmonics of the higher notes are not readily available, and wire back techniques must be employed so that octave-lower frequencies may be used as substitutes. Due to the uniformity of the chips, attenuation of the wired-back tones may be incorporated onto the chips, to avoid overload problems.

In order to obtain synchronization among all the C dividers, a final divider stage 32 is provided with an output at half the frequency on line 33 of the lowest frequency used in tone generation to provide the proper resetting interval. Line 33 is coupled to a sync generator circuit 34 which generates a sync pulse at supply voltage level, which is higher than the clock pulses so that the sync pulse can be superimposed on the clock pulse line at the one half of lowest tone frequency rate indicated above. This generated sync pulse superimposed on the clock pulses is coupled to a sync separator circuit 36 which generates a clear pulse for resetting all like dividers which have sync separators as shown in FIG. 3. Thus, the superimposed synchronization pulse is coupled on clock line 28 to the C dividers which are generating the third harmonic tones for the F keyers on the C#FA divider keyer package.

The third harmonic divider chains associated with each of the keyer circuits on the four divider keyer packages are essentially similar to the divider string shown in FIG. 3 with the exception that there is no sync generation 34, and there are two or three fewer dividers such as 32 in order to generate the lowest necessary frequency. The third harmonic generator string in the position of the G dividers in FIG. 2 has six dividers and the divider strings in the position of the D# and B dividers of FIG. 2 have five dividers.

The square wave signal outputs from the dividers are directly coupled to the keyers from the third harmonic dividers without the interposition of any gate circuits such as 37 or 38 as are used with the lower frequency outputs of the primary divider strings as illustrated in FIG. 3. In order to enhance the even harmonics, and suppress the objectionable square wave characteristic normally present in the lower frequencies, and in order to use an approximately three octave filter grouping for the lower frequencies, gating circuits 37 and 38 are provided on the low end outputs of the primary divider chains for each of the keyer sections. This enhancement of desirable harmonics at the low end enables the use of seven filter groups rather than eight saving one pin terminal for each divider keyer package. For the package 11 illustrated in FIG. 2, the C dividers 21 and E dividers 30 are connected as shown in FIG. 3. The G# dividers 25 are connected as shown with the addition of the dotted line connection at 40.

Figure 4:
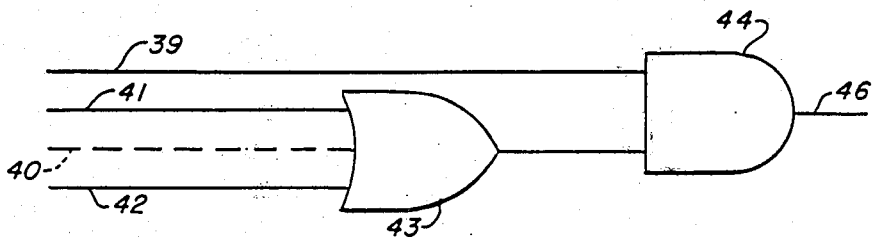
FIG. 4 is a more detailed showing of the gate circuits of FIG. 3.

With the exception of dotted line 40, FIG. 4 shows the gate circuit 37 of FIG. 3. The lowest tone frequency is coupled on line 39 to AND gate 44. Twice that frequency, 2f, is coupled on line 41 to OR gate 43 and frequency 4f is coupled on line 42 to OR gate 43. The output of OR gate 43 is the other input to AND gate 44. This combination of gate inputs provides a rectangular pulse on output 46 which is high $\frac{3}{8}$ of the time and low $\frac{5}{8}$ of the time. Without dashed line connection 40, gate 38 has an output on line 47 which is also high $\frac{3}{8}$ of the time and low $\frac{5}{8}$ of the time. The output of $37\frac{1}{2}$ percent duty cycle rectangular wave on line 46 is coupled to the subfundamental keyer for the lowest C note in keyer section 23. The $37\frac{1}{2}$ percent duty cycle wave form on line 47 is coupled to the fundamental keyer for the lowest C and the subfundamental keyer for the second lowest C.

These connections are the same in each primary divider section (E and G#) on divider keyer package 11. However, for the G# divider output corresponding to line 47 (and for the keyer section A, A# or B of the other three note packages) the dashed line connection 40 is made supplying a frequency of 8f to gate circuit 38. As shown in FIG. 4, this is an additional input to OR gate 43. This adds 1/16 to the duty cycle of the rectangular wave form so that the output on line 47 is high 7/16 of the time. This intermediate duty cycle of rectangular wave, half way between the $\frac{3}{8}$ of line 46 and the one half of the square wave outputs such as 31, smooths the transition from square waves to rectangular waves. This intermediate duty cycle rectangular wave is, as indicated above, provided on the lowest G# fundamental keyer and second lowest G# subfundamental keyer and the corresponding keyers for the other note letters in the G# position in the other packages.

As shown in FIG. 5, each keyer group receives a keying input for the nine harmonic components of the played key. In FIG. 5 scaling signals (not shown) for each of the nine harmonics is obtained from the drawbar selection circuit and each of the nine harmonic keyers also receives an appropriate tone signal (not shown) from the dividers as indicated above. In FIG. 5 the outputs (not shown) from the typical keyer section 50 are assembled with the other keyer outputs into the above-described seven filter groups. The configuration of the FET keyers is set forth in the above-mentioned U.S. Pat. Nos. 3,636,231 and 3,748,944 together with a description of the basic synthesis organ keyboard divider keyer circuitry from which the present embodiment was evolved.

The practicality of using the standard 40 pin package for a divider keyer chip in a four-chip 61 note manual system was made possible through the combination of borrowing fifth harmonic clock signals from within a single chip, the ability to predictably wire back top harmonic frequencies internally due to uniformity among chips, use of synchronization pulses superimposed on clock lines, and use of progressive duty cycle rectangular waves for the lower fundamental frequencies.

What is claimed is:

1. A divider keyer circuit arrangement for a 61 note electronic synthesis organ keyboard having a plurality of harmonic controls which includes four identical forty pin integrated circuit packages, each of which comprises:

a first note-related keyer section having six keyer groups each of which is coupled to a different keying wave form input line and each of which has a plurality of keyers coupled to a different harmonic control line;

a first primary divider section coupled to a first clock line to a top octave clock generator output for said first note and including a series of dividers operable to divide said generator output successively by two to produce a series of tone signal divider outputs and further including means for generating a synchronization signal on said first clock line and further including synchronization signal detection means coupled to said first clock line for detecting said synchronization signal and resetting said dividers in response thereto;

a first third-harmonic divider section coupled to a first third-harmonic clock line to a top octave clock generator output for a note third harmonically related to said first note, said third-harmonic top octave clock generator output being utilized as a primary divider section top octave source for a note on a different one of said four identical integrated circuit packages, and including a series of dividers operable to divide said output successively by two to produce a series of tone signal divider outputs and further including synchronization signal detection means coupled to said first third-harmonic clock line for detecting a synchronization signal placed on said clock line by the synchronization signal generating means of the primary divider section which receives said third-harmonic top octave clock generator output as a source and is located on said different one of said four identical integrated circuit packages and for resetting said third-harmonic dividers in response thereto; and a second note-related keyer section having five keyer groups, a third note-related keyer section having five keyer groups, a second primary divider section, a third primary divider section, a second third-harmonic divider section, and a third third-harmonic divider section;

said first note-related keyer section being coupled to said tone signal divider outputs from said first primary divider section, to said tone signal divider outputs from said first third-harmonic divider section, and to one tone signal divider output from said second primary divider section to borrow a signal equal to the fifth harmonic of said first note from said second primary divider section;

said second note-related keyer section being coupled to tone signal divider outputs from said second primary divider section, to tone signal divider outputs from said second third-harmonic divider section, and to one tone signal divider output from said third primary divider section to borrow a signal equal to the fifth harmonic of said second note from said third primary divider section; and said third note-related keyer section being coupled to tone signal divider outputs from said third primary divider section, to tone signal divider outputs from said third third-harmonic divider section, and to one tone signal divider output from said first primary divider section to borrow a signal equal to the fifth harmonic of said third note from said first primary divider section.

2. The circuit arrangement of claim 1 in which said divider section outputs are square waves and which further includes first gating means coupled between the first primary divider section outputs and the first keyer section keyers for combining a plurality of said divider section outputs into a single gate output line signal coupled to said first keyer section and having a rectangular waveform whose duty cycle is 37.5%.

3. The circuit arrangement of claim 2 further including second gating means coupled between the first primary divider section outputs and the first keyer section keyers for combining a plurality of said first divider section outputs into a single gate output line signal coupled to said first keyer section and having a rectangular waveform whose duty cycle is 43.75%.

4. The circuit arrangement of claim 3 in which the keyers of the first, second and third keyer sections have outputs which are grouped into a plurality of frequency-related output lines.

5. The circuit arrangement of claim 4 in which there are seven output lines in said plurality of frequency-related output lines.

6. The circuit arrangement of claim 1 in which there are nine harmonic controls in said plurality of harmonic controls.

7. In a divider keyer integrated circuit package for a synthesis electronic organ having a top octave signal source, a progressive duty cycle tone signal generation circuit comprising:

divider means coupled to said top octave signal source for producing a series of 50% duty cycle square wave outputs;

first gating means for combining a plurality of said square wave outputs and providing as a first gating means output a rectangular wave having a 37.5% duty cycle for enhancing the second and fourth harmonics and reducing the level of third harmonics;

second gating means for combining a plurality of said square wave outputs and providing as a second gating means output a rectangular wave having a duty cycle between 50% and 37.5% for providing a smooth transition between said harmonically enriched 37.5% duty cycle rectangular wave and said 50% duty cycle square wave; and keyer means coupled to said divider means outputs, said first gating means output and said second gating means output for keying said square waves and rectangular waves.

* * * * *